US006904952B2

(12) United States Patent
Skerdi et al.

(10) Patent No.: US 6,904,952 B2
(45) Date of Patent: Jun. 14, 2005

(54) FEEDER COMPRISING A TUBULAR BODY

(75) Inventors: Udo Skerdi, Bendorf (DE); Georg Scheerer, Waldmorh (DE)

(73) Assignee: AS Lungen GmbH & Co. KG, Bendorf (DE)

( * ) Notice: Subject to any disclaimer, the term of this patent is extended or adjusted under 35 U.S.C. 154(b) by 0 days.

(21) Appl. No.: 10/433,236

(22) PCT Filed: Nov. 2, 2001

(86) PCT No.: PCT/EP01/12730

§ 371 (c)(1),
(2), (4) Date: Jul. 24, 2003

(87) PCT Pub. No.: WO02/43899

PCT Pub. Date: Jun. 6, 2002

(65) Prior Publication Data

US 2004/0050526 A1 Mar. 18, 2004

(30) Foreign Application Priority Data

Nov. 30, 2000 (DE) ..... 100 59 481
Aug. 30, 2001 (DE) ..... 101 42 357

(51) Int. Cl.[7] ..... B22C 9/08
(52) U.S. Cl. ..... 164/359; 164/360

(58) Field of Search ..... 164/359, 360

(56) References Cited

U.S. PATENT DOCUMENTS 4,526,338 A 7/1985 Reiland

FOREIGN PATENT DOCUMENTS

| | | | |
|---|---|---|---|
| DE | 35 00809 A | * | 7/1985 |
| DE | 36 14629 A | * | 11/1987 |
| DE | 4200183 | | 7/1992 |
| DE | 42 00 183 | | 7/1992 |
| DE | 4119192 | | 12/1992 |
| DE | 19503456 | | 11/1995 |
| DE | 19642838 | | 7/1997 |
| DE | 19925167 | | 12/2000 |
| DE | 10039519 | | 2/2002 |

* cited by examiner

*Primary Examiner*—Kiley S. Stoner
*Assistant Examiner*—Len Tran
(74) *Attorney, Agent, or Firm*—Scott R. Cox

(57) ABSTRACT

This present invention concerns a feeder system for a cast piece with a feeder and/or feeder head and a tubular body, characterized in that the tubular body connects the feeder and/or feeder head directly or indirectly with the cast piece and/or the mold cavity.

20 Claims, 3 Drawing Sheets

FEEDER COMPRISING A TUBULAR BODY

DESCRIPTION

This present invention concerns a feeder system for a cast piece with a feeder (head) as well as a tubular body.

In the production of molded parts in foundries, liquid metal is filled into a casting mold. During the hardening process, the volume of the filling material is reduced. For that reason, so-called feeders, i.e. open or closed spaces in or on the casting mold, are commonly used to make up for the deficit in volume which occurs as the cast piece hardens and to prevent pipe formation in the cast piece. For that purpose, such feeders are connected with the cast piece and/or the respective section of the cast piece that is affected thereby and are usually located above and/or on the side of the mold cavity.

Several types of feeders are known from prior art. For example, DE 196 42 838 A1 describes a feeder for a metallic cast piece in the form of a bell with a retracted rim, wherein such rim is formed by a flat ring element attached thereto.

DE 41 19 192 A1 describes a spring-supported pin to secure feeders. The feeder inserts are placed on a pin connected with the casting mold and preferably molded into the cope box. Since the feeder material is very flexible and the sand pressure easily causes damage to the inserted feeder during the molding process in the molding system, it is known from prior art to provide the pin in a spring-supported, axially movable manner to allow the molded feeder to move away from the sand pressure in the direction towards the model.

Usually, the feeders are located approximately at the cutting height and, additionally, equipped with a heat-insulating material and/or an exothermic material in such a manner that the molten metal located in the feeder hardens later than the cast piece itself. After hardening, the feeder remains connected with the cast piece, as a result of which the remaining feeder needs to be separated afterwards. In many cases, cleanly and easily separating the feeder from the cast piece is problematic. As a general rule, after separating the feeder, the surface of the cast piece still needs to be deburred and smoothened. This is a complicated and, consequently, costly procedure which may also cause damage to the surface of the cast piece at its contact point with the feeder. To reduce such damage and facilitate the separation of the feeder, so-called breaking cores (also referred to as breaking edges) are frequently provided. They are installed between the feeder and the casting mold and require suitable contact surfaces.

Generally speaking, prior art feeders are either relatively complicated insofar as their construction and/or handling during the manufacture of casting molds is concerned and/or do not guarantee easy and precise separation of the remaining feeder from the cast piece, or they require a relatively large contact surface.

Based on the above, the object of this present invention is to provide a feeder system which overcomes the drawbacks of prior art devices and, in particular, has a simple construction, which can be easily secured to and/or molded onto the casting mold, and only requires small contact surfaces while, at the same time, permitting a precisely positioned breaking edge directly on the cast piece for easy and safe separation of the remaining feeder from the finished cast piece.

This object is achieved by a feeder system in accordance with the invention. Preferred embodiments hereof are disclosed in the Specification.

As used herein, the term "feeder" covers all types of feeders, feeder jackets, feeder inserts, and feeder caps as well as heating pads that are known from prior art or to those in the art.

As a basic rule, this present invention is suitable for all types of feeders containing a tubular body which can be arranged as described below.

In particular, this present invention is suited for so-called minifeeders which are usually molded on by means of a breaking edge or by using a spring-supported pin.

The feeder system in accordance with this present invention comprises at least two parts. On one hand, on the side facing away from the cast piece, a feeder and/or feeder head is provided which forms a cavity to receive the liquid metal during the casting process.

Towards the cast piece, a tubular body is provided which, whether directly or indirectly, connects the cavity formed by the feeder head to the cavity of the cast piece.

The tubular body can be of any desired and, depending on the case, suitable length, wall thickness, and diameter. Depending on the material that is used, the wall thickness will usually range from 0.1 mm to 10 mm, in particular from 0.3 mm to 5 mm, particularly preferably from 0.3 mm to 0.5 mm. The optimal dimensions can be determined, on a case-by-case basis, through routine testing and/or are known to those in the art, based on their experience. The wall thickness also varies depending on the material used and may, in case steel sheet and a spring-supported pin-equipped minifeeder are used, be roughly 0.3 mm to 0.5 mm.

Usually, the tubular body has a length between approx. 15 and approx. 300 mm; in particular between approx. 35 and approx. 100 mm. In one embodiment of this present invention, the length of the tubular body is chosen such as to cover at least the distance between the feeder (prior to molding; optionally on the pin) and the cast piece.

As a general rule, the internal diameter of the tubular body can be chosen as desired; the opening should be large enough, however, to ensure the flow of the molten metal into and/or out of the feeder during the casting and hardening process. Usually, although not necessarily, the diameter of the tubular body depends on the internal diameter of the feeder, considering that, in accordance with one embodiment of this present invention, the tubular body is fitted and/or inserted into the feeder (head). However, the tubular body can also be connected with the feeder (head) in a different manner.

The tubular body may have any desired cross-sectional shape, in particular a round, oval, rectangular or multiangular geometry.

In accordance with one embodiment of this present invention, the tubular body is a tube with a cross-section which essentially remains the same over the its entire length. Preferably, the ratio between the wall thickness and the overall diameter of the tube is roughly between 1:2 and 1:200, in particular between 1:5 and 1:120, and particularly preferably between 1:10 and 1:100. The ratio between the length and the overall diameter of the tube is preferably between approx. 1:4 and 15:1, in particularly between 1:1 and 6:1. In particular, the ratios are determined by the feeder and casting mold geometries.

The feeder and/or feeder head may be made of any prior-art insulating and/or exothermic material to ensure that the molten metal located in the feeder hardens after the cast piece itself. For example, the feeder may be manufactured from the exothermic feeder materials disclosed in DE 199 25 167, filed by this applicant.

The tubular body can be manufactured from any suitable material which has sufficient strength and does not cause any undesired reactions in the cast piece to be provided with a feeder. These materials are known to those in the art and include, among others, metals, plastics, cardboard, ceramics, or similar materials.

In a preferred embodiment hereof, the tubular body is made from a material similar to the casting mold, such as aluminum or iron sheet.

In a preferred embodiment of this present invention, the external circumference of the tubular body is in close contact with the feeder and/or feeder head, and preferably, the tubular body is connected thereto by using means that are known to those in the art, e.g. a glue, such as a hot glue or water glass, a wedge, or by means of a fitting. The tubular body may also be simply inserted into the feeder (head).

In another preferred embodiment of this present invention, however, the tubular body is movable with respect to the feeder and/or feeder head and/or the cast piece and/or the mold cavity, at least within certain limits. As a result, on one hand, a particularly uncomplicated connection of the feeder can be ensured, and on the other hand, optimal positioning of the breaking edge can be achieved due to the displacement between the feeder and/or tubular body and the cast piece which occurs during the molding-on process and/or densification of the molding material.

As a result of the densification of the molding material and the corresponding relative displacement between the feeder and/or tubular body and the cast piece and/or mold cavity, the distance between the tubular body and the cast piece can be easily adjusted prior to the molding process in such a manner that, after the molding-on process and/or densification of the molding material, the tubular body provides an optimally positioned breaking edge which is as close as possible to the finished cast piece.

In a preferred embodiment of this present invention, the tubular body narrows in the direction towards the cast piece and forms a breaking edge directly at the entrance to the casting mold and/or in the immediate vicinity thereof. Needless to say, in accordance with a preferred embodiment of this present invention, only a certain section, preferably a section facing the cast piece, may have a tapering or narrowing of the (internal) diameter. As a result, the tubular body serves, on one hand, to provide a feeder neck that can be molded on and, on the other hand, to provide a precise and firmly positioned breaking edge. Preferably, the breaking edge is a narrowing of the opening and/or internal diameter on or in the proximity of that end of the tubular body which faces the cast piece.

In another preferred embodiment of this present invention, however, the tubular body does not narrow in the direction towards the cast piece and/or does not have a narrowed section. It may be preferable to push the tubular body, e.g. an essentially cylindrical tube, onto a pin, in particular a spring-supported or guiding pin, until that end of the tubular body which faces the cast piece comes to rest on the leg of the pin in the vicinity of the cast piece. Between the tubular body and the (leg of the) pin, a small gap is formed. It has been shown that such a gap, together with the air inclusions in this area that form during the molding process, may also lead to the formation of an acceptable breaking edge. In addition, as explained in detail above, by properly sizing the tubular body, the position and shape of the breaking edge can be optimized, e.g. by using a relatively small tube with a small diameter or by properly positioning the feeder and/or feeder head in such a manner that, after the molding-on process and/or densification of the molding material, the feeder and/or feeder head is located in the vicinity of (although not directly on) the cast piece.

In a preferred embodiment hereof, the feeder system in accordance with this present invention, as mentioned above, furthermore comprises a pin, in particular a spring-supported pin.

The feeder connected with the tube (tubular body) is properly kept up by the spring-supported pin. The tube rests in an upright position on the mold and/or the beveled bottom of the spring-supported pin. During the molding process, the feeder is guided downwards over the tube into the corresponding end position by the spring-supported pin. The tube remains firmly in its original position. This ensures that a defined breaking edge is provided directly on the cast piece.

Within the scope of this present invention, any core, pin, or spring-support pin that appears suitable to those in the art may be used. Towards the cast piece, the tubular body may either completely project over the spring-supported pin or rest on its leg. In both cases, a connection between the mold cavity and the tubular body is provided (either directly or indirectly).

In accordance with another preferred embodiment hereof, the tubular body may be used as a spring-supported pin and/or guiding pin replacement. The feeder is guided over the tubular body resting on the casting mold in an upright position and centered, optionally by means of a permanently positioned pin, whose length may be different. Preferably, the permanently positioned pin is no longer than the tubular body. In many cases, however, it may be preferable that the permanently positioned pin be shorter than the tubular body, and the latter is pushed over the permanently positioned pin, at least partially. During the densification process, the feeder is then pushed over the tubular body. In a preferred embodiment in accordance with this present invention, in the upper section, the feeder is destroyed by the tubular body. The broken parts of the feeder are then embedded in the molding sand.

For each cast piece, the tubular body must be adjusted in such a manner that the distance between the feeder and the cast piece still ensures sufficient feeding. In many cases, this distance will be between 5 and 25 mm.

Towards the top, the tubular body may be open or closed.

In a preferred embodiment of this present invention, the tubular body may, in case it is open on the side facing away from the cast piece, be supported by a relatively long receiving pin, and in this case, the tubular body is preferably made from a solid material, such as steel sheet, e.g. with a material thickness of approx. 0.7 mm. Other solid materials, such as plastics, e.g. PE, or ceramics, however, may also be preferable. Preferably, in the upper section, the tubular body is perforated to ensure proper ignition of the feeder. Towards the cast piece, no holes and/or openings should be present in the tubular body, considering that this would lead to the penetration of molding sand during the molding-on process.

With respect to yet another embodiment of this present invention, it has been found that, in some cases, it may also be advisable, for easy handling, that the tubular body is not directly connected, prior to the molding-on process and/or densification of the molding material, with the cast piece and/or the mold cavity, or rests on the spring-supported pin (if any).

The feeder system can be designed in such a manner that the tubular body, during the molding-on process and/or the densification of the molding material, moves in the direction of the cast piece and/or mold cavity. In accordance with such embodiment, the tubular body has a relatively thin wall thickness, as a result of which the tubular body can cut through the same towards the cast piece during the molding-on process and/or the densification of the mold material. Additionally, this can be facilitated by providing the tubular body, on the end facing the cast piece, with some type of a cutting edge, by reducing the wall thickness of the tubular body in this area, or by making the wall of the tubular body particularly thin in this area.

Preferably, the feeder system is sized and positioned opposite the cast piece in such a manner that, once the spring path has been adjusted after the molding-on process and/or completed densification of the molding material on the tubular body, a defined breaking edge is formed between is the feeder and the cast piece.

Preferably, to be able to properly move and/or cut through to the cast piece during the densification of the molding material, the tubular body itself has a relatively thin wall, which allows it to penetrate through the molding material to the cast piece and/or to the mold cavity. Preferably, the wall thickness of the tubular body is approx. 0.05 mm to 1 mm, in particular 0.2 to 0.5 mm, in case a solid material such as steel sheet, plastics, or ceramics are used. Of course, the wall of the tube must be sufficiently stable so as not to be destroyed during the densification of the molding material, to such an extent that no feedable connection exists any longer between the mold cavity and the feeder. For that reason, the preferred wall thickness of the tubular body depends on the type of material used.

Suitable wall thickness for the type of material chosen are known to those in the art or may be optimized by means of routine testing.

In a preferred embodiment hereof, the cutting process is supported insofar as the tubular body finds a stop and/or a contact surface in the feeder, as a result of which the tubular body is pressed, together with the feeder and/or the feeder head, towards the cast piece.

This support can be provided by a stop and/or a contact surface. In this context, the term "stop" refers to a special shape on a wall, in particular an interior wall, of the feeder and/or feeder head, which comes into contact, at least during the molding-on process and/or densification of the molding material, with a single point or a surface of the end of the tubular body facing away from the cast piece.

Of course, the tubular body may also be supported with respect to the feeder and/or feeder head by using a suitable glued, wedged, or fitted system between the tubular body and the feeder and/or feeder head, as already described, for example, in DE 100 59 481.6, or by a contact point or a contact surface which supports the tubular body with respect to the feeder and/or feeder head at least after the molding-on process and/or densification of the molding material.

In case a spring-supported pin is provided, prior to the molding-on process and/or densification of the molding material, the tubular body preferably does not rest on the leg of the spring-supported pin, but advances to the leg of the spring-supported pin as the molding material is densified. In accordance with this present invention, it is also possible that the tubular body, in case no spring-supported pin is provided, independently cuts and/or pushes itself to the cast piece and/or mold cavity.

It has been found that the feeder system in accordance with this present invention can be connected to and molded onto the casting molds in a very simple and universal manner, ensuring a reproducible and optimally positioned breaking edge, even in case a pin and/or spring-supported pin is used. After the molding process and, optionally, the removal of the core or (spring-supported) pin, the tubular body is left behind in the mold. The feeder system may be installed on the casting mold either in the plant or later on the client's premises.

Additionally, the feeder system in accordance with this present invention eliminates the need for other processes, such as the use of a commercially available breaking core, e.g. a Croning core, to produce a suitable breaking edge.

To the extent that the embodiments described herein also refer to the arrangement of the feeder and/or feeder head, the tubular body, the spring-supported and/or guiding pin, or the permanently positioned pin with respect to the cast piece and/or mold cavity, another aspect of this present invention also refers to a casting arrangement comprising the above defined feeder system and the cast piece/the mold cavity (and a molding material) and/or a method for preparing a casting mold by using the feeder system in accordance with this present invention.

Another aspect of this present invention refers to the use of a tubular body to form a feeder neck which can be is molded thereonto comprising a breaking edge, for feeders for cast pieces.

This present invention shall be explained in more detail in the description below, which refers to the drawings attached hereto.

Figure 1:
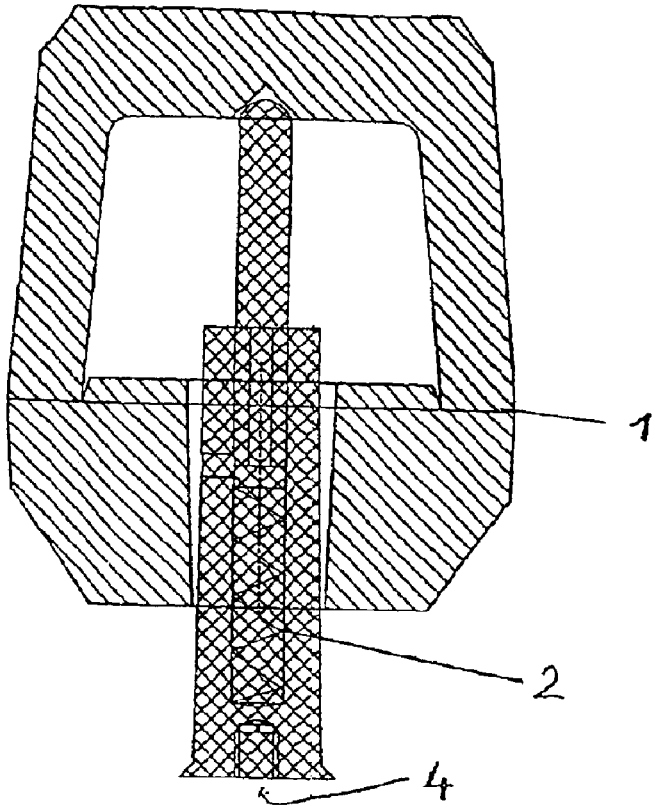
FIG. 1 shows a conventional feeder with a spring-supported pin.
Figure 3A:
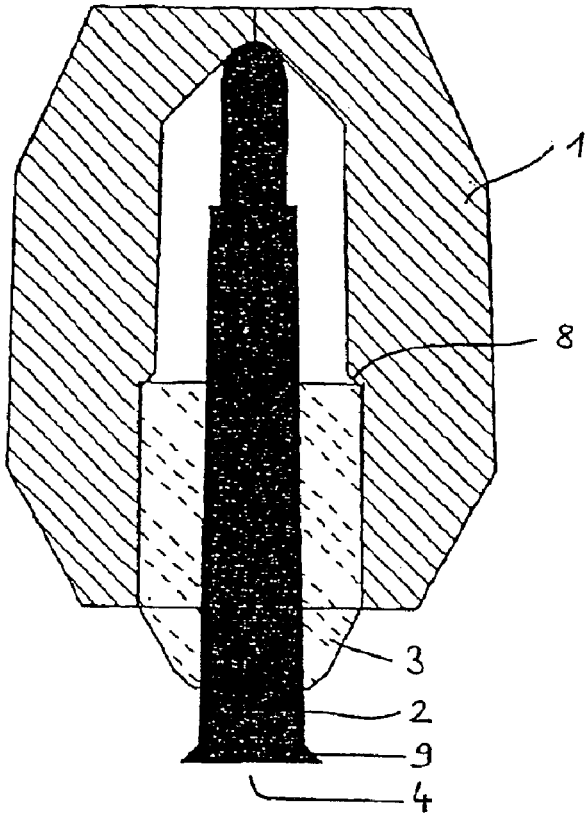
Figure 3B:
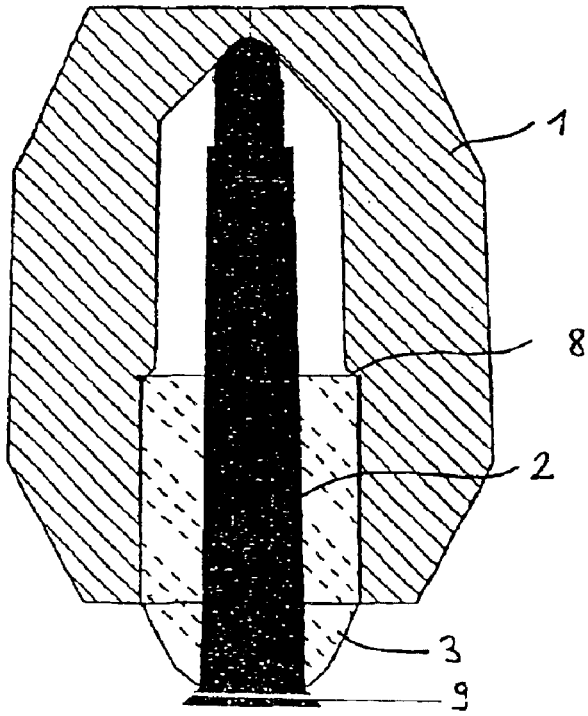
Figure 4A:
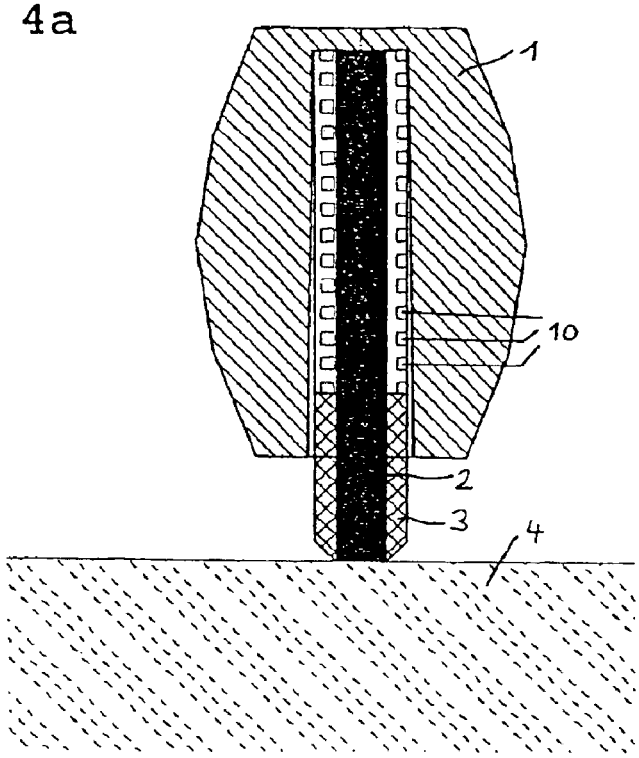
Figure 4B:
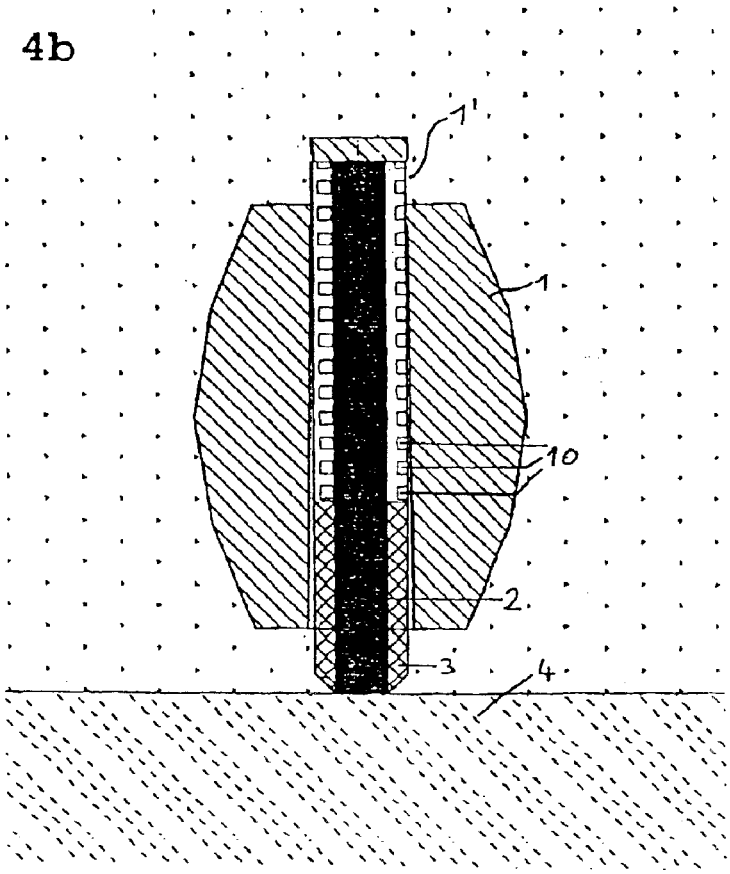

FIG. 3*a* shows a feeder system in accordance with this present invention with a tubular body prior to the molding process and/or the densification of the molding material;

FIG. 3*b* shows a feeder system in accordance with this present invention with a tubular body after the densification of the molding material, and FIGS. 4*a* and 4*b* show another embodiment of the feeder system in accordance with this present invention, wherein the tubular body has holes and/or openings in its part facing away from the cast piece;

FIG. 1 shows a conventional feeder 1 made from an exothermic and/or insulating material which has been placed on the cast piece 4 via a spring-supported pin 2. No optimal breaking edge is provided for separating and/or removing the remaining feeder.

Figure 2:
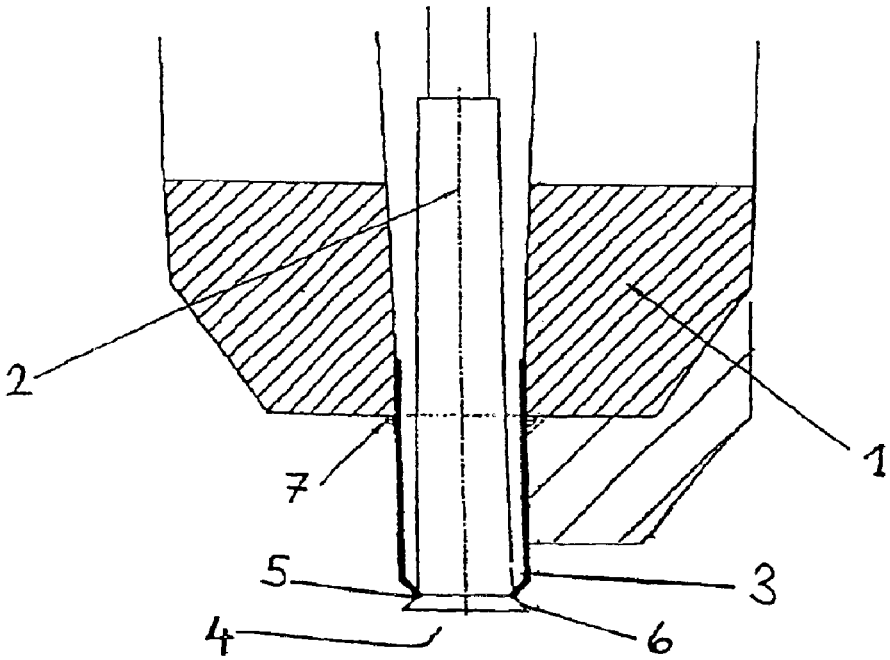
FIG. 2 shows a feeder system in accordance with this present invention with a tubular body, which narrows towards the cast piece.

FIG. 2 shows a feeder system in accordance with this present invention wherein, via the spring-supported pin 2, a tubular body 3 is guided which tapers off in the direction of the cast piece 4, providing a breaking edge 5. The tubular body tapers off towards the cast piece and rests on the leg and/or base 6 of the spring-supported pin. Onto the tube, a feeder (head) 1 had been placed, and to seal off the feeder and circumference of the tube, a hot glue seam 7 is provided. Upon completion of the molding process, the feeder occupies the position indicated by the hatched lines; the relative movement occurs between the tubular body and the feeder, and the position of the breaking edge on the tubular body remains the same with respect to the cast piece. This ensures optimal positioning of the breaking edge regardless of the final post-molding position of the feeder.

FIG. 3 shows a feeder system in accordance with this present invention wherein, on the internal wall of the feeder (head) 1, a projection and/or a stop 8 is provided for the tubular body 3. The tubular body 3 tapers off in the direction of the cast piece and/or mold cavity 4 and can, during the molding-on process and/or the densification of the molding material, cut through the molding material and advance towards the cast piece.

As explained in more detail in the general description of this present invention, the spring path can be adjusted in such a manner during the densification of the molding material that the breaking edge forms on the leg of the pin 2 in the proximity of the cast piece. It is also possible that the tubular body does not have any narrowing and is essentially cylindrical.

FIG. 3*a* shows the feeder system prior to the densification of the molding material, and the end of the tubular body facing the cast piece does not rest on the leg 9 of the spring-supported pin and/or is directly connected with the cast piece or the mold cavity.

FIG. 3*b* shows the feeder system after the densification of the molding material, and the tubular body is directly connected with mold cavity and/or rests on the leg 9 of the spring-supported pin 2, if available, or the cast piece.

FIGS. 4*a* and 4*b* show yet another embodiment of the feeder system in accordance with this present invention, wherein the tubular body 3 has holes and/or openings 10 in its part facing away from the cast piece. In the embodiment shown here, the tubular body rests on the cast piece 4 already prior to the molding-on process and/or the densification of the molding material. After the molding-on process and/or the densification of the molding material (FIG. 4*b*), the feeder head 1 was deliberately destroyed in the upper section 1', causing a relative movement between the tubular body 3 and the feeder head 1.

What is claimed is:

1. A feeder system connected with a cast piece or a mold cavity comprising at least two parts:

a first part, facing away from the cast piece, comprising a feeder or a feeder head which comprises a cavity to receive liquid metal during a casting process; and a second part, facing towards the cast piece, comprising a tubular body, which connects the cavity in the feeder or feeder head to a cavity of the cast piece; wherein the tubular body narrows in cross section or internal diameter towards its end facing the cast piece or mold cavity to thereby contribute to the formation of a breaking edge in the tubular body.

2. The feeder system of claim 1, wherein the tubular body has an essentially uniform diameter and an essentially cylindrical or cylindrical shape.

3. The feeder system of claim 1, wherein the feeder or feeder head comprises a stop or a contact surface and the tubular body abuts at the stop or contact surface with its end facing away from the cast piece or mold cavity.

4. The feeder system of claim 3, wherein the stop or contact surface is formed as a projection on an inside surface of the feeder or feeder head.

5. The feeder system of claim 3, wherein the stop or contact surface is formed as two or more contact points or an annular contact surface.

6. The feeder system of claim 3, wherein the stop or contact surface is located on a lateral interior wall or an upper interior wall of the feeder or feeder head and the tubular member is at least partially inserted into the feeder or feeder head.

7. The feeder system of claim 1, wherein the tubular body further comprises a thin wall such that the tubular body can cut or push itself through to the cast piece during a molding-on process or during densification of the molding material.

8. The feeder system of claim 1, wherein during a molding-on process or during densification of the molding material, the tubular body essentially does not move with respect to the cast piece or mold cavity, and the feeder or feeder head does move with respect to the cast piece or mold cavity.

9. The feeder system of claim 1, wherein during a molding-on process or during densification of the molding material, the tubular body essentially does not move with respect to the feeder or feeder head, but does move with respect to the cast piece or mold cavity.

10. The feeder system of claim 1, further comprising a spring-supported pin or guiding pin, wherein the tubular body is at least partially pushed over one of said pins.

11. The feeder system of claim 10, wherein the tubular body, prior to the molding-on process or during densification of the molding material, does not rest with its side facing the cast piece or mold cavity on the mold or spring-supported or guiding pin.

12. The feeder system of claim 10, wherein the feeder or feeder head, the tubular body, and the spring-supported pin or guiding pin are sized such that, after the molding-on process or densification of the molding material, the tubular body forms the breaking edge on a side facing the cast piece and the feeder or feeder head does not directly rest on the cast piece or mold cavity.

13. The feeder system of claim 10, wherein the tubular body, after the molding-on process or densification of the molding material, rests on a leg of the spring-supported or guiding pin, thereby forming the breaking edge in the proximity of the cast piece.

14. The feeder system of claim 1, wherein the tubular body further comprises a permanently positioned pin provided to center the tubular body.

15. The feeder system of claim 14, wherein the length of the permanently positioned pin does not exceed that of the tubular body and the tubular body is at least partially pushed over the permanently positioned pin.

16. A moldable feeder neck for feeders for cast pieces comprising the feeder system of claim 1.

17. A process for casting comprising preparing the feeder system of claim 1, preparing a cast piece or mold cavity and a molding material and installing the feeder system to the cast piece or mold cavity prior to the molding-on or densification of the molding material.

18. A process for casting comprising preparing the feeder system of claim 1, preparing a cast piece or mold cavity and, without directly connecting the feeder system to the cast piece or mold cavity, resting the feeder system on the cast piece or mold cavity such that a pin of the feeder system rests on the cast piece or mold cavity or the feeder system cuts through to the cast piece during densification of the molding material.

19. A feeder system connected with a cast piece or a mold cavity, said feeder system comprising at least two parts a first part, situated at a side facing away from the cast piece, forming a feeder or a feeder head which comprises a cavity to receive liquid metal during a casting process, said cavity being closed at its end facing away from the cast piece;

a second part, situated at the side facing towards the cast piece, which is formed by a tubular body, which connects the cavity formed by the feeder or feeder head to the cavity of the cast piece, wherein the tubular body narrows in cross section or internal diameter towards its end facing the cast piece or mold cavity;

wherein the tubular body is at least partially inserted into the cavity of the feeder or feeder head such that the tubular body with its end facing away from the cast piece or mold cavity abuts at the upper end of the cavity of the feeder or feeder head such that after the molding on process or the densification of the molding material, the feeder head is destroyed in its upper section, causing a relative movement between the tubular body and the feeder head.

20. The feeder system of claim 19, wherein the tubular body has holes or openings facing away from the cast piece.

* * * * *